United States Patent [19]

Hopkins

[11] 4,028,010

[45] June 7, 1977

[54] REVERSIBLE, VARIABLE-DISPLACEMENT PISTON PUMP WITH POSITIONER MEANS FOR AUTOMATIC RETURN TO ZERO DISPLACEMENT

[75] Inventor: Donald L. Hopkins, Joliet, Ill.

[73] Assignee: Caterpillar Tractor Co., Peoria, Ill.

[22] Filed: June 20, 1975

[21] Appl. No.: 588,919

Related U.S. Application Data

[63] Continuation-in-part of Ser. No. 481,798, June 21, 1974, abandoned.

[52] U.S. Cl. ..... 417/217; 417/222; 60/444; 60/452

[51] Int. Cl.[2] ..... F04B 1/26; F16D 31/02

[58] Field of Search ..... 417/217, 218, 219, 220, 417/221, 222; 60/444, 452; 123/179 F

[56] References Cited

UNITED STATES PATENTS

| | | | |
|---|---|---|---|
| 2,594,790 | 4/1952 | Morley | 417/216 |
| 3,106,057 | 10/1963 | Manning et al. | 417/222 |
| 3,130,684 | 4/1964 | Firth et al. | 91/396 |
| 3,302,585 | 2/1967 | Adams et al. | 417/213 X |
| 3,489,094 | 1/1970 | Vaughan et al. | 417/53 |
| 3,643,550 | 2/1972 | Lease | 91/506 |
| 3,654,758 | 4/1972 | Aoyama et al. | 123/179 F |
| 3,732,037 | 5/1973 | Carlson | 417/217 |
| 3,738,779 | 6/1973 | Hein et al. | 417/213 |
| 3,834,836 | 9/1974 | Hein et al. | 417/222 |
| 3,881,317 | 5/1975 | Swoager | 60/452 |

*Primary Examiner*—Carlton R. Croyle
*Assistant Examiner*—Thomas I. Ross
*Attorney, Agent, or Firm*—Phillips, Moore, Weissenberger, Lempio & Majestic

[57] ABSTRACT

A variable displacement pump having a tiltable swash plate including a pair of servo mechanisms for controlling discharge of pump fluid includes a zero displacement positioner for automatically returning the pump swash plate to a central, neutral position to discontinue pumping action if pump pressure is lost or if linkage controlling one of the servo mechanisms should break or otherwise fail.

7 Claims, 2 Drawing Figures

REVERSIBLE, VARIABLE-DISPLACEMENT PISTON PUMP WITH POSITIONER MEANS FOR AUTOMATIC RETURN TO ZERO DISPLACEMENT

CROSS REFERENCE TO RELATED APPLICATIONS

This application is a continuation-in-part of application Ser. No. 481,798, filed June 21, 1974, and entitled "Zero Displacement Positioner" now abandoned.

BACKGROUND OF THE INVENTION

This invention is directed to a variable displacement pump of the type having a plurality of rotatable, axially oriented pistons guided by a non-rotatable, tiltable swash plate which enables adjustment of pump displacement. More particularly, this invention is directed to a zero displacement positioner incorporated with a servo mechanism for returning the swash plate to a central,neutral position in the event of a failure in the pump system.

Reversible variable displacement pumps are frequently employed in the drive systems of vehicles to supply fluid pressure to hydrostatic motors for driving the vehicle wheels. The components of such a drive system are subject to failures which may occur suddenly and unexpectedly during the operation of the vehicle.

Some examples of such failures are: breakage of the mechanical linkage between the operator control and the servo mechanism controlling the pump; malfunctions in the pump itself or in the hydrostatic motor; a rupture in the hydraulic lines between the pump and motor; or a loss in pump charging pressure. When such failures occur, it is often necessary to immediately stop the discharge of pressure fluid from the pump in order to prevent further damage. Discharge should also be stopped to prevent the loss of large quantities of hydraulic fluid or the possible injury of the operator. Present pumps lack the ability to automatically shut down the pump when a failure such as that described above occurs. Therefore, the necessary immediate remedial action is not accomplished and the undesirable consequences indicated above frequently occur.

Variable displacement pumps of the type described which include servo mechanisms for their operation also require a pilot pressure system for operation. These pilot pressure systems utilize a lower pressure than that discharged by the pump. This results in an additional disadvantage since the servo piston must be relatively large to provide sufficient force to overcome the swivel torque exerted by the pump pistons.

SUMMARY AND OBJECTS OF THE INVENTION

It is therefore the primary object to effect a solution of the above and other problems that this invention is directed.

It is also an object to provide a mechanism for automatically returning a swash plate of a reversible, variable displacement pump to a central, neutral position which is responsive to failure.

It is a further object to provide such a mechanism which returns the pump to a zero displacement position in response to failures in the pump system such as a loss of hydraulic pressure.

It is a further object to provide such a mechanism which acts as a zero displacement positioner in response to mechanical failure such as breakage of the pump servo control linkage.

It is a further object to provide a servo mechanism for controlling a variable displacement pump which utilizes full pump discharge pressure and thus minimizes the servo piston size and consequent bulk of the servo and pump housing.

It is a still further object to provide such a servo mechanism of relatively non-complex construction which is inexpensive and relatively easy to produce.

The invention takes the form of a variable displacement pump having a tiltable swash plate and a pair of servo mechanisms for controlling discharge of pump fluid. The pump includes a zero displacement positioner for returning the pump swash plate to a central, neutral position to discontinue pump discharge if the pump pressure is lost or if linkage controlling a servo mechanism should break or otherwise fail.

Other and further objects will become more readily apparent from having reference to the following description and claims and the accompanying drawings, which, by illustration only, shown a preferred embodiment of the present invention and the principles of operation thereof.

DETAILED DESCRIPTION

Figure 1:
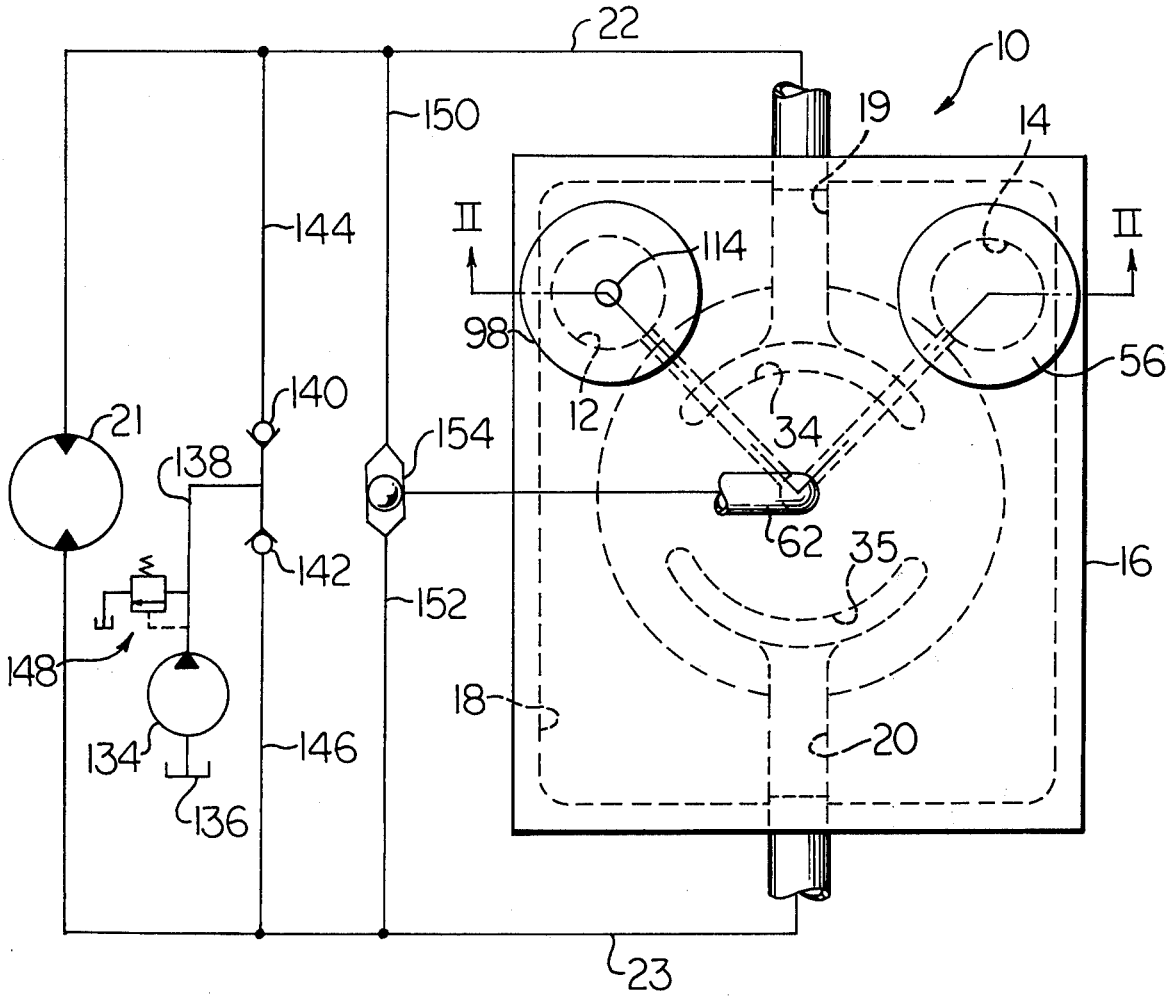
FIG. 1 is a top plan view of a reversible, variable displacement pump of the present invention; and, FIG. 2 is a vertical, cross-sectional view of the variable displacement pump taken in the direction II—II in FIG. 1 and illustrating details thereof.

Referring to FIG. 1, there is shown generally at 10 a top plan view of a variable displacement pump containing two vertical bores 12, 14, which are offset from the pump centerline. Contained within these bores are the mechanisms for changing pump displacement as will be hereinafter described. The pump body consists of a hear 16 seated on a housing 18. A pair of fluid passages 19 and 20 are contained within the head and individually connected to a respective one of a pair of conduits 22 and 23 for alternately conducting fluid to and from a hydrostatic motor 21.

Figure 2:
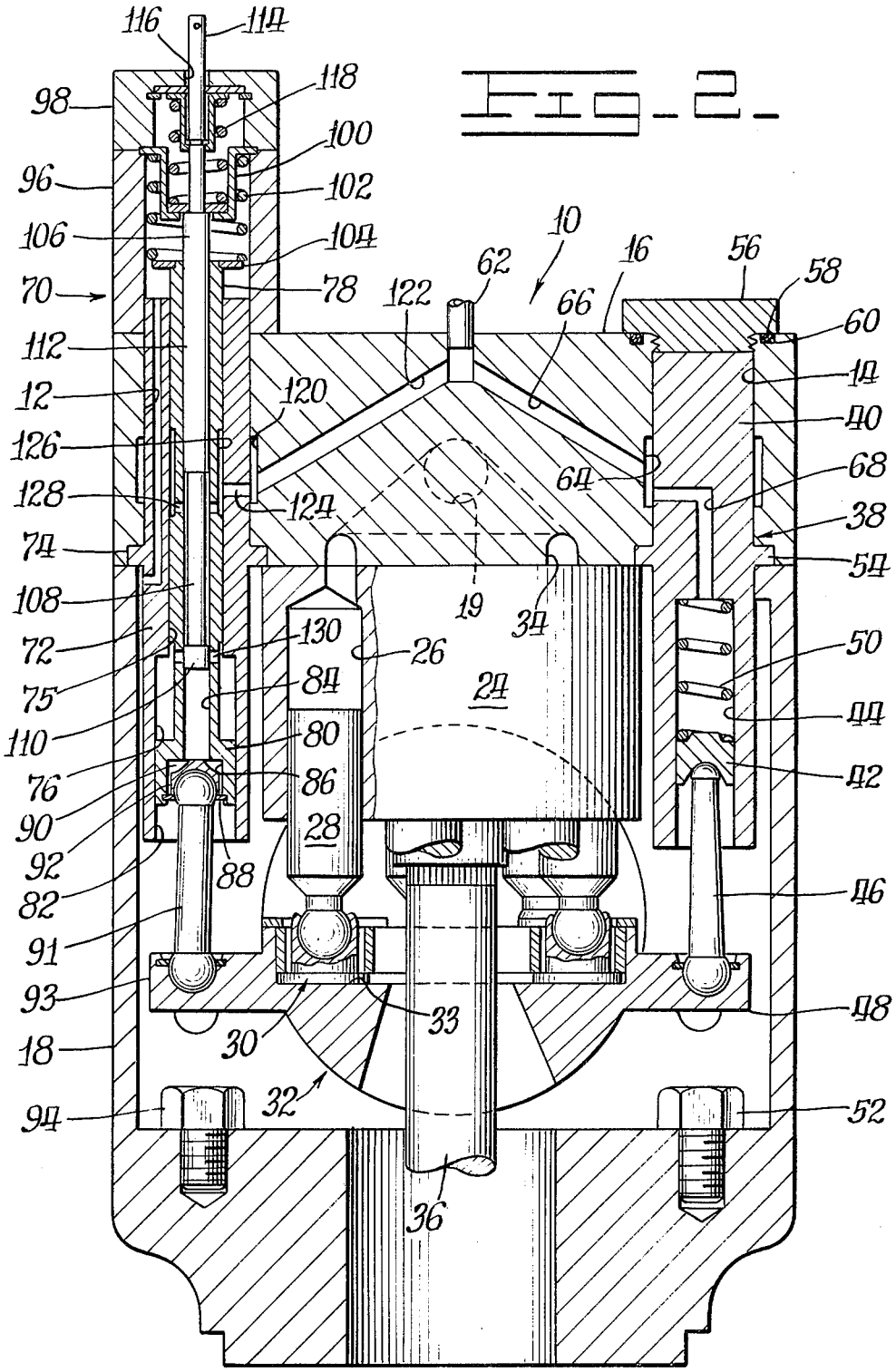

Turning to FIG. 2, there is shown a vertical, cross-sectional view of the variable displacement pump 10 taken along line II—II in FIG. 1. A pump cylinder barrel 24, having a plurality of axially oriented bores one of which is shown at 26 has a plurality of reciprocably mounted pistons 28 disposed therein. Pistons 28 are individually and collectively guided by a slipper pad assembly 30, rotatably, slidably mounted on support means in the form of a nonrotatable, but tiltable swash plate 32. Swash plate 32 is pivotable about a transverse axis by a pair of oppositely disposed pivot pins (not shown) retained in transverse bores (not shown) in the sides of housing 18.

The angle of tilt of swash plate 32 with respect to the axial direction of the bores 26 determines the amount of stroke or displacement of pistons 28 in the conventional manner. Since slipper pad assembly 30 is ball-and-socket-joint connected to pistons 28, which, in turn, ride on a surface 33 of the swash plate, it will be appreciated that if swash plate 32 were rotated clockwise about its pivot point from the position in which it is shown, the reciprocating action of the pistons 28 in their respective bores 26 would cause fluid to be discharged from the pump 10 through conduit ZZ by way of a kidney port 34 and passage 19 during counterclockwise rotational operation, as viewed in FIG. 1, of the pump cylinder barrel 24. The rotation of swash plate 32 in a counterclockwise direction would cause similar fluid displacement through passage 20 and a kidney port 35, FIG. 1, disposed on the opposite side of the pump.

The pump cylinder barrel 24 is rotated by a shaft 36 drivingly connected to an engine or other power means (not shown). When swash plate 32 is in the neutral or horizontal position shown, operation of the pump will result in zero displacement of fluid therefrom. Cartridge assembly 38 includes a housing 40 fitted into the bore 14. A piston 42 is slidably mounted within a chamber 44 formed within the lower end of the housing 40. A push rod 46 connects the piston to an arm 48 extending from one side of the swash plate 32.

Swash plate 32 is swiveled toward a maximum reverse displacement stop 52 by a swash plate biasing spring 50 disposed within the chamber 44, and reacts against the housing 40. An annular flange 54 is formed on housing 40 to securely locate cartridge assembly 38 between the pump housing 18 and head 16. The entire cartridge assembly 38 is secured by a nut 56 which abuts against the top surface of head 16 and annular seal ring 58 contained in an annular groove 60 therein.

Fluid pressure in a conduit 62 is intercommunicated with an annulus 64 by way of a passage 66. Pressure will then be communicated into a passage 68 contained in the cartridge housing 38. Fluid under pressure in passage 68 is then directed to chamber 44 where it works against the piston 42.

Cartridge assembly or servo mechanism 70 includes a housing 72 mounted within vertical bore 12. An annular flange 74 formed on the housing 72 securely locates the assembly between pump housing 18 and head 16. Housing 72 is provided with a longitudinal bore 75 formed therethrough and communicating with a larger diameter chamber or counterbore 76 formed in the lower end of the housing and concentric with bore 75.

An internal follow-up sleeve 78 is slidably mounted within bore 75 and includes a piston 80 formed on the lower end thereof. Piston 80 is slidably mounted in the larger diameter chamber 82. The surface area of piston 80 exposed to the chamber 76 is greater than the surface area of piston 42 exposed to chamber 44. Follow-up sleeve 78 is also provided with a longitudinal bore 84 formed therethrough. A larger concentric bore 86 is formed in the piston 80 for mounting a push rod bearing member 88. Bearing member 88 is provided with a plurality of notches 90 and grooves 92 for relieving fluid pressure in the lower end of the bore 84.

Push rod 91 has one end fitted within bearing member 88 and the outer end engaging another arm 93 on the opposite side of the swash plate 32 from the arm 48. In this manner a downward force exerted on the piston 80 urges swash plate 32 toward a maximum forward displacement stop 94.

Fitted on top of the head 16 around the upper end of the cartridge assembly 70 is a tubular housing 96. A cup-shaped cap 98 is fitted on top of the housing 96 for closing the open upper end thereof and is secured thereto by screw or other means (not shown).

A cup-type spring retainer 100 is secured between cap 98 and housing 96 for mounting a second swash plate biasing spring 102 against a washer 104 fitted on the upper end of the sleeve 78. Swash plate biasing springs 50 and 102 are provided with an equal spring rate and preload so as to provide an equilibrium of forces acting on the swash plate when it is disposed in the neutral position shown.

An elongated valve spool 106 is slidably mounted within bore 84 of sleeve 78. Spool 106 includes an elongated annular groove or reduced diameter portion 108 disposed between a short land 110 formed on the lower end of the spool and an upper land 112. A reduced diameter stem 114 extends from the upper land 112 through an aperture 116 formed through the cap 98. The stem 114 is connectable to a manually actuated linkage mechanism (not shown) for selective operation of the valve spool 106. A spool centering spring 118 is associated with valve spool 106 for returning the spool to a neutral position upon the release of an actuating force applied to the spool through the linkage mechanism.

Fluid pressure in conduit 62 which is directed to the cartridge assembly 38 is also directed to the cartridge assembly 70 through an annulus 120 by way of passage 122. Pressure is then communicated into a passage 124 provided through housing 72 to an annular groove 126 formed in sleeve 78. A passage 128 formed through sleeve 78 communicates the fluid pressure to the annular groove 108 of the valve spool 106. A passage 130 formed at a lower point in sleeve 78 communicates bore 84 with chamber 76.

In operation, the discharge of fluid pressure from either of the fluid passages 19 and 20 is dependent upon the respective counterclockwise or clockwise disposition of the swash plate 32.

However, prior to start up when the swash plate is in its normal, neutral position necessary pressure to "cock" or initially tilt the swash plate is provided by an auxiliary pump 134 which draws fluid from a sump 136. The fluid is then directed through a conduit 138 and past one-way check valves 140,142 through conduits 144,146, respectively. Fluid is then directed from conduits 144,146 through conduits 22,23, respectively. A pressure relief valve 148 is provided to relieve pressure in conduit 138 on the output side of auxiliary pump 134. At start up, auxiliary pump 134 provides the necessary fluid pressure through conduits 22 or 23 and thence to conduits 150,152 to shuttle-type check valve 154 and thence to conduit 62. After start up, fluid pressure will be generated in either of passages 19 or 20 by pump 10. When sufficient pressure is generated by pump 10, check valves 140,142 will operate to ensure that back flow to auxiliary pump 134 will not take place.

In either case, both before and after start up, fluid pressure in conduit 62 is directed to chamber 44 to work against the piston 42 by way of passage 66, annulus 64 and passage 68. Thus, piston 42 will urge swash plate 32 toward maximum reverse stop 52 which will cause follow-up sleeve 78 to be moved upwardly by push rod 91. This permits communication of chamber 76 with annular groove 108 by way of passage 130.

However, pump pressure in conduit 62 is also directed to annular groove 108 by way of passage 122, annulus 120, passage 124, annular groove 126 and passage 128. Because piston 80 has a greater working area than piston 42, swash plate 32 will rotate toward maximum forward stop 94 until the passage 130 is blocked by valve spool land 110, which will equalize the forces acting on the swash plate 32. Thus, the angular position of swash plate 32 is determined by the linear position of land 110 of valve spool 106 which is controlled manually through stem 114, as aforementioned.

If spool 106 is moved downwardly, land 110 will uncover passage 130 which will permit additional fluid pressure to enter chamber 76. This will cause counterclockwise swiveling of the swash plate and downward movement of follow-up sleeve 78 until land 110 will once again cover passage 130.

In a similar fashion, if spool 106 is moved upwardly, land 110 uncovers passage 130 to permit the release of fluid pressure from chamber 76. This will cause the clockwise swiveling of swash plate 32 and the upward movement of sleeve 78. The fluid pressure in chamber 76 is released through bore 84, notches 90 and slots 92 of bearing member 88.

If pump pressure is lost due to a failure, such as a rupture in the hydraulic lines 22 and 23 between the pump 10 and the driving motor 21, fluid pressure acting on the pistons 42 and 80 will also be lost. In such an event, biasing springs 50 and 102 will immediately take effect to automatically return swash plate 32 to the horizontal or zero displacement position, as shown, to thereby discontinue the pumping action of the pump and prevent further loss of hydraulic fluid or damage to related components.

In a similar fashion, if the manually actuated linkage controlling valve spool 106 breaks or becomes inoperative, centering spring 118 automatically returns the valve spool 106 to its neutral position, as shown, which also positions swash plate 32 in the described neutral position.

It is to be understood that the foregoing description is merely illustrative of a preferred embodiment of the invention, and that the scope of the invention is not to be limited thereto but is to be determined by the scope of the appended claims.

What is claimed is:

1. In a reversible, variable displacement piston pump of the type having a housing including a pair of fluid passages for intake of fluid into and a discharge of fluid from said housing, a rotatable pump cylinder barrel within said housing, a plurality of pistons reciprocable within piston bores in said cylinder barrel, an angularly adjustable swash plate defining a pair of opposite ends, said swash plate being pivotally mounted intermediate said opposite ends, for determining piston displacement and thereby the amount of fluid discharged from the pump, a first servo mechanism in said housing for rotating said swash plate through a central, zero displacement position for discharge of pressurized fluid in one direction against a load, a second servo mechanism in said housing for rotating said swash plate in the opposite direction through said central, zero displacement position for discharge of pressurized fluid in the reverse direction against a load, zero displacement positioner means for automatically returning said swash plate to a central, zero displacement position to thereby discontinue the pumping action of the pump if pump discharge pressure is lost, wherein said zero displacement positioner means comprises a first piston means within said first servo mechanism and first spring means within said first servo mechanism biasing said first piston means against one end of said swash plate, wherein said first servo mechanism comprises a first servo housing having an axial bore therethrough and said first piston means comprises a tubular sleeve slidably fitted within said axial bore and a first piston on one end of said sleeve and slidably contained within a first chamber contained within the first servo housing, the bore of the tubular sleeve being connected with the first chamber by passage means, and further comprising valve spool means movably mounted within the bore of the tubular sleeve for selective blocking and unblocking of the passage means, and a second piston means within said second servo mechanism and second spring means within said second servo mechanism biasing said second piston means against the opposite end of said swash plate, wherein said second servo mechanism comprises a second servo housing and said second piston means comprises a second piston slidably contained within a second chamber within said second servo housing, and further including means supplying pump discharge pressure (i) to said first chamber through the tubular sleeve, and (ii) to the second chamber to power the servo mechanisms to tilt and swash plate away from said central, zero displacement position, and further including auxiliary fluid pressure generating means for providing fluid pressure (i) to said first chamber through the tubular sleeve, and (ii) to the second chamber to power said servo mechanisms and to initially tilt said swash plate away from said central, zero displacement position, the auxiliary fluid pressure generating means ceasing operation upon establishment of pump pressure, and means for providing unblocking of the passage means by the valve spool means when pump discharge pressure is lost, for providing that the first chamber is communicated with relief conduit means for providing unloading of fluid pressure from the first chamber.

2. The invention of claim 1 wherein said pump housing includes a control conduit and passage means therein intercommunicating said control conduit with said second chamber for controlling movement of said second piston.

3. The invention of claim 2 wherein said pump housing further comprises passage means therein intercommunicating said control conduit with passage means in said first servo housing and said sleeve and thence to said first chamber.

4. The invention of claim 1 wherein said first servo housing includes an aperture therein and said valve spool includes a stem extending through said aperture whereby movement of said valve spool may be controlled by a control linkage.

5. The invention of claim 4 wherein said zero displacement positioner means further comprises third spring means biasing said valve spool to a neutral position whereby the swash plate is automatically returned to a central, zero displacement position to thereby discontinue the pumping action of the pump if the control linkage should break or otherwise fail.

6. The invention of claim 1 wherein said auxiliary fluid pressure generating means comprises an auxiliary pump and means communicating said auxiliary pump with said pair of fluid passages.

7. The invention of claim 6 further including check valve means in said means communicating said auxiliary pump with said pair of fluid passages whereby backflow to said auxiliary pump is prevented.

* * * * *